United States Patent [19]

Lyman et al.

[11] 4,165,140

[45] Aug. 21, 1979

[54] VACUUM CLEANER ATTACHMENT WAND WITH DEMOUNTABLE ELECTRICAL CONNECTOR

[75] Inventors: John B. Lyman, Bloomington; Bruce E. Stewart, Maplewood, both of Minn.

[73] Assignee: Whirlpool Corporation, Benton Harbor, Mich.

[21] Appl. No.: 878,733

[22] Filed: Feb. 17, 1978

[51] Int. Cl.[2] ..... H01R 3/04

[52] U.S. Cl. ..... 339/15; 174/47; 339/76; 339/91 R

[58] Field of Search ..... 339/15, 16 R, 75 M, 339/76, 91 R, 91 F; 174/47

[56] References Cited

U.S. PATENT DOCUMENTS

| | | | |
|---|---|---|---|
| 2,987,693 | 6/1961 | Wamsley | 339/91 R |
| 3,034,085 | 5/1962 | Pauler et al. | 339/16 R |
| 3,127,227 | 3/1964 | Edwards | 339/15 |
| 4,063,790 | 12/1977 | Kleykamp et al. | 339/91 R X |

*Primary Examiner*—Roy Lake
*Assistant Examiner*—DeWalden W. Jones
*Attorney, Agent, or Firm*—Wegner, Stellman, McCord, Wiles & Wood

[57] ABSTRACT

A connector and a slide particularly useful in a floor tool wand for a powered or a nonpowered floor tool for a vacuum cleaner. A slide is mounted on the wand and electrical power is provided to a connector which is adapted to be mounted adjacent the slide. The slide has two generally parallel sides and each side is provided with an outwardly opening notch and a stop. A plug (male) electrical connector is slid along the slide for engagement therewith, and a pivotable lock, which engages the notches, selectively retains the plug connector against the stops.

14 Claims, 5 Drawing Figures

FIG. 1
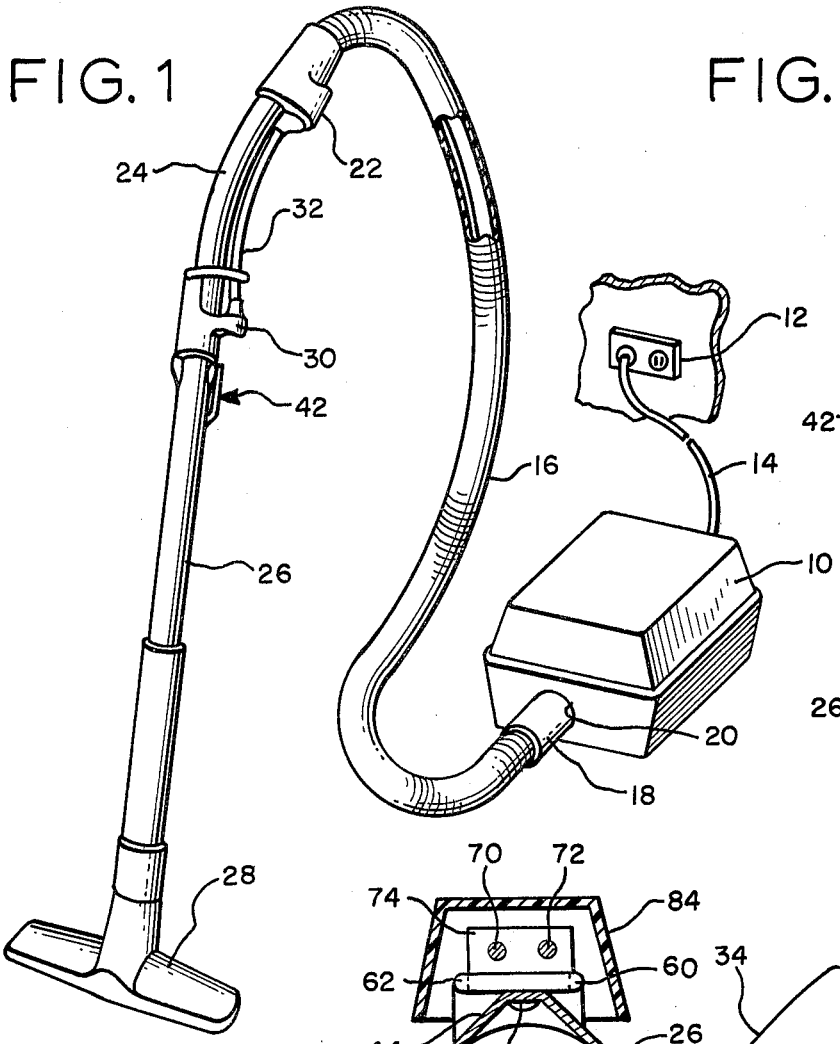
FIG. 2
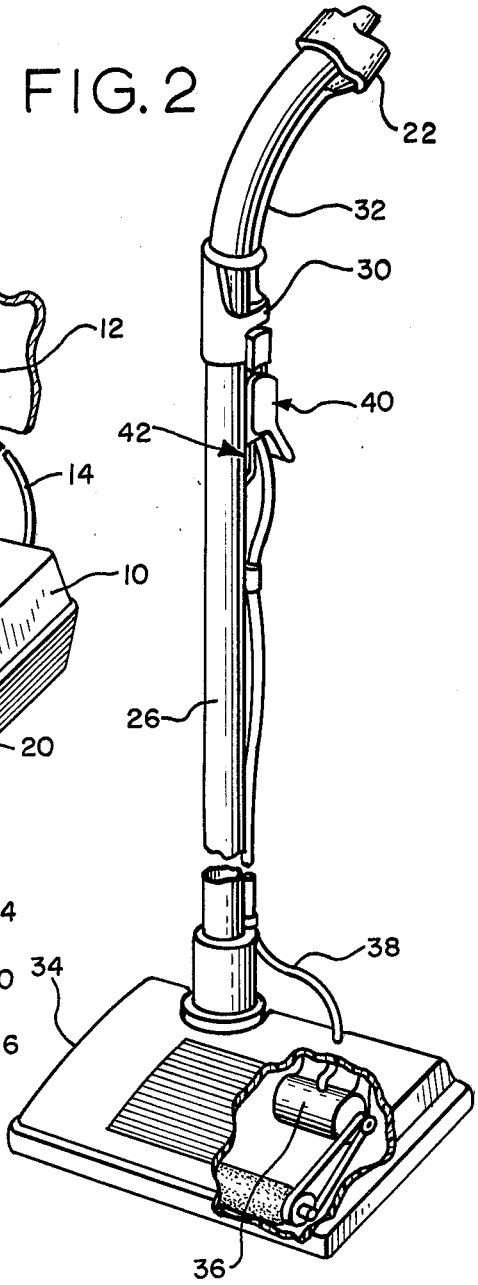
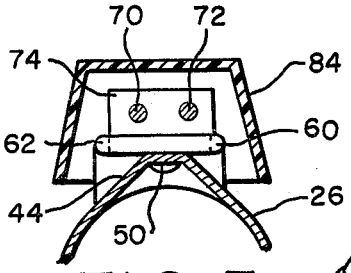
FIG. 5
FIG. 4
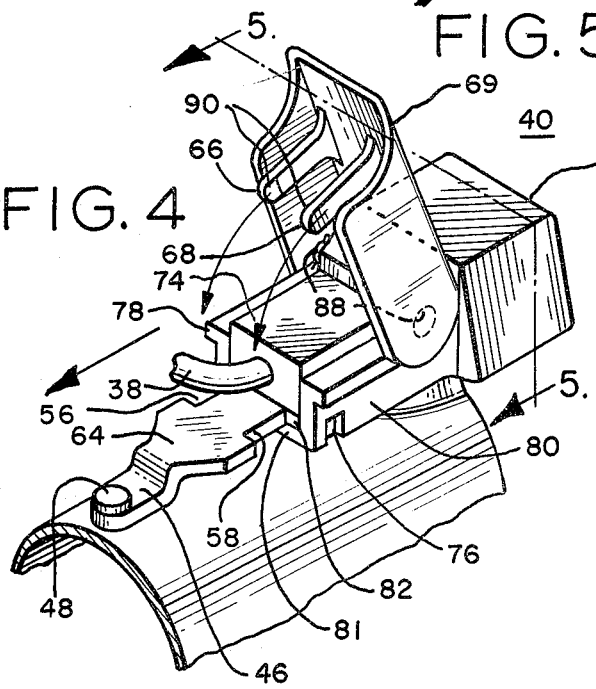
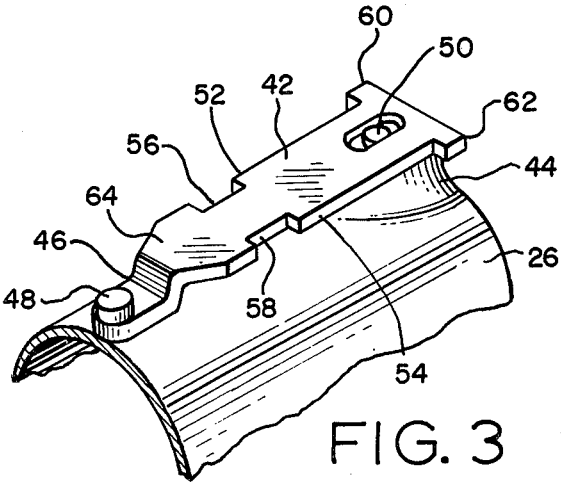
FIG. 3

VACUUM CLEANER ATTACHMENT WAND WITH DEMOUNTABLE ELECTRICAL CONNECTOR

BACKGROUND OF THE INVENTION

This invention generally relates to vacuum cleaners and, more particularly, to an operator-held wand for a vacuum cleaner. The wand may be used with an electrically powered or a non-electrically powered floor tool.

It is desirable to be able to use either a powered floor tool or a nonpowered floor tool with a vacuum cleaner. When cleaning rugs or carpets, a power tool is often preferred since the power brushes clean deep into the pile of the carpet or rug. It is equally desirable to employ a nonelectric floor tool when cleaning draperies, sofas and furniture, for example. Thus, the operator may be required to substitute floor tools several times during cleaning.

To accommodate a powered floor tool, electricity is usually provided from the vacuum cleaner to an operator-held wand by an electrical cord which may be disposed within the flexible vacuum hose. The cord terminates in a connector at its end. The connector is simply constructed and may be made of molded plastic. When the cord from the power tool is connected to the connector, power is delivered to the floor tool. U.S. Pat. Nos. 3,034,085, 3,127,227 and 3,314,039 disclose such a system. These systems are not as desirable for use with a nonpowered floor tool because the electrical connector on the wand is cumbersome and tends to interfere with the operator during use.

We have developed a wand and connector structure for a vacuum cleaner which may be used with powered and nonpowered floor tools. During use with powered floor tools the electrical connector does not interfere with the operation of the system. If the operator selects a nonpowered floor tool, the connector is easily removed from the wand, and the connector mounting structure does not interfere with nonpowered floor tool use of the wand.

The disclosed demountable electrical connector arrangement is easily mounted on the vacuum cleaner wand and demounted therefrom by the vacuum cleaner operator in situations when the operator is switching from electrically operated attachments to non-electrically operated attachments in the course of cleaning activities.

The use of the disclosed demountable connector arrangement avoids the need to plug a separate connector into the vacuum cleaner hose on each occasion of using an electrically operated attachment while still permitting the wand to be used with a non-electrically operated attachment.

When the vacuum cleaner operator is cleaning an area that has surfaces requiring an electrically operated attachment such as carpet and other surfaces needing cleaning when using a canister vacuum cleaner having non-electrically operated attachments carried therewith, the operator can readily switch back and forth between electrically and non-electrically operated attachments without the need for carrying extra wands along as in the case when the electrical connector for the electrically operated attachment is permanently affixed to the vacuum cleaner wand.

The demountable connector arrangement includes a locking member which also serves as an operating or manipulating handle in removing and replacing the connector holder on the mount carried by the vacuum cleaner wand.

The connector holder can be mounted on the wand either before or after the wand is connected to a vacuum cleaner hose. Likewise, the holder and electrical connector can be removed before or after the wand is disconnected from the vacuum cleaner hose. Thus, the vacuum cleaner operator has complete flexibility in the use of the electrically operated and non-electrically operated attachments.

The following U.S. patents were also considered in connection with the present invention: U.S. Pat. Nos. 811,836, 1,595,919, 2,987,693, 3,035,243 and 3,778,863.

SUMMARY OF THE INVENTION

A slide forms a mounting surface for a plug-retaining connector at the end of a wand for a vacuum cleaner. The wand may be used with electrically powered and non-electrically powered floor tools. A releasable lock on the connector mounting structure retains the connector on the slide when engaged. The slide has stops and notches and when fingers on the releasable lock engage the notches, the connector is restrained between the notches and the stops. The wand, with or without the connector mounted thereon, does not interfere with the operation of the vacuum cleaner.

It is a feature of the present invention to provide a wand which has a connector mounting slide that does not interfere with the operator of the vacuum cleaner.

Another feature of the present invention is to provide a connector which is easily removed from the wand and easily reconnected by the operator.

Yet another feature of the present invention is to provide a connector mounting structure that is simply constructed and which can be made of molded plastic.

These and other features of the invention will become apparent when considering the following description in connection with the drawing in which:

DRAWING

FIG. 1 is a perspective view of a nonpowered floor tool coupled to the wand of the present invention;

FIG. 2 is a perspective view of a powered floor tool coupled to the wand of the present invention;

FIG. 3 is a perspective view of the slide on which the connector for the powered floor tool mounts;

FIG. 4 is a perspective view of the electrical connector mounted on the slide; and FIG. 5 is a cross-sectional view of the connector, slide and wand taken through the line 5—5 of FIG. 4.

DESCRIPTION OF PREFERRED EMBODIMENT

Referring to FIG. 1, a canister-type vacuum cleaner 10 is provided with electricity from outlet 12 connected to a power source by cord 14 connected to vacuum cleaner 10 and plugged into outlet 12. Flexible vacuum hose 16, having internal electrical conductors (not shown) and an appropriate coupling 18, is detachably mounted at the canister vacuum cleaner intake fitting 20.

Flexible hose 16 has a molded plastic end 22 which receives preformed hollow tube 24. The preformed hollow tube 24 is rigidly attached to end 22 and is preformed to provide a curved handle in order that the operator may conveniently guide wand 26 and thereby control the position of non-electrically powered floor tool 28 during cleaning. The wand 26 is of a length sufficient for convenient operation by the operator, and the floor tool 28 is mounted at the end of wand 26 in a swivel manner to accommodate the variations in the cleaning surface during vacuuming. For reasons that will become apparent below, integrally formed electrical connector 30 is affixed to preformed tube 24. Connector 30 is provided with electrical current from conductor 32 which leads back to vacuum cleaner 10 through flexible hose 16. Thus, electrical power is provided to the end of the preformed hollow tube 24. Whether or not the power provided to the end is used or not depends upon the selection of the particular floor tool.

As shown in FIG. 1, a nonpowered floor tool 28 is coupled to wand 26, and the power available at electrical connector 30 is not used.

Referring to FIG. 2, a powered floor tool 34 is connected to wand 26. The powered floor tool is powered by motor 36 which receives power from cord 38. Cord 38 includes electrical conductors and terminates in a connector 40, having prong terminals 70 and 72, which receives power from connector 30 mounted at the end of preformed tube 24.

Referring to FIG. 3, a slide 42 is mounted on the end of wand 26 to retain connector 40 in attachment to connector 30 when the powered floor tool is used. The end of the wand is provided with flared portion 44 and the slide 42 has an offset end 46. The flared portion 44 and the offset end 46 cooperate to space the slide 42 from the outer surface of the wand 26. The slide is attached to wand 26 by rivets 48 and 50, and its axis is generally parallel to the axis of the wand.

Referring to FIGS. 3–5, a description of the connector 40 and slide 42 will now be provided. Slide 42 has two generally parallel sides 52 and 54 and, as stated previously, the slide is spaced apart from the outer surface of wand 26. Sides 52 and 54 each have outwardly opening notches 56 and 58, respectively. Stops 60 and 62 are provided at the end of slide 42 to stop the forward movement of connector 40 along the longitudinal axis of the wand when connector 40 is locked in place. Also, slide 42 has a tapered section 64 which spreads flexible fingers 66 and 68 on a pivoting locking structure 69 (see FIG. 4) as the connector 40 is slid on slide 42 when the locking structure 69 is in its locked position. When engaged, the flexible fingers 66 and 68 are received within the outwardly opening notches 56 and 58 of slide 42 to retain the connector 40 against stops 60 and 62, thereby assuring the electrical connection of metal prong terminals 70 and 72 within connector 30.

The connector 40 retains a molded plug 74 which is electrically connected to conductor 38. The plug 74 has opposing outwardly extending protrusions which are received within the slots, as slot 76, of sides 78 and 80 of connector 40. The distance between the sides 78 and 80 is selected to accommodate slide 42. The sides 78 and 80 each have an inwardly extending ridge, as ridge 81, which form channels, as channel 82 with the undersurface of plug 74. The slide 42 is received by the channels.

A hood 84 of generally trapezoidal cross-sectional configuration is integrally formed with sides 78 and 80 to cover the prongs 70 and 72 of plug 74. The sides 78 and 80 and hood 84 may be of a single molded plastic part.

Flexible fingers 66 and 68 are an integral part of locking structure 69 which pivots about sides 78 and 80 at pivot 88 as shown in FIG. 4. Locking structure 69 may be a single molded plastic part with opposed pivot projections at pivot 88, which may be received in shoulder portions formed in sides 78 and 80 and retained by projections (not shown) on plug 74. When engaged, fingers 66 and 68 are retained within the outwardly opening notches 56 and 58. Also, flexible fingers 66 and 68 may be provided with inwardly extending lips, as lip 90, to retain the flexible fingers within notches 56 and 58.

The connector 40 may be removed from slide 42 by rotating locking structure 86 clockwise, as shown in FIG. 4, and sliding the connector in the direction of the arrow.

The foregoing disclosure of a specific embodiment is illustrative of the broad inventive concepts comprehended by the invention.

Having described the invention, the embodiments of the invention in which an exclusive property or privilege is claimed are defined as follows:

1. A floor tool wand for a floor tool of a vacuum cleaner comprising:

a rigid hollow tube;

an elongated slide having generally parallel sides on and spaced apart from the surface of the hollow tube, the axis of the slide being generally parallel to the axis of the hollow tube, the slide having outwardly extending stop means and notch means spaced apart from the stop means;

a plug electrically coupled to the floor tool;

a connector retaining the plug;

the connector and the plug forming axially extending channels receiving the slide; and a movable lock for selectively retaining the connector against the stop means.

2. The floor tool wand of claim 1 wherein:

the movable lock has a pair of spaced-apart fingers received in the notch means when the lock retains the connector against the stop means.

3. The floor tool wand of claim 2 further including:

a tapered section at an end of the slide and adjacent the notch means for spreading the pair of fingers as the connector is slid along the slide.

4. The floor tool wand of claim 3 wherein the fingers have inwardly extending lips which engage the notch means to aid in retaining the fingers in said notch means.

5. The floor tool wand of claim 1 wherein the stop means is two opposed protrusions extending outwardly from the sides of the slide.

6. The floor tool wand of claim 1 wherein the movable lock is a single molded plastic part.

7. The floor tool wand of claim 1 wherein the plug is a male plug having prongs.

8. The floor tool wand of claim 1 wherein the movable lock is manually pivotally movable into a position for retaining the connector against the stop means.

9. The floor tool wand of claim 1 wherein the connector has two sides and one side of each channel is formed by a ridge extending inwardly from the side.

10. The floor tool wand of claim 9 further including a hood integrally formed with the sides covering the plug.

11. In a wand for a floor tool of a vacuum cleaner, an improved electrical connector mounting structure at the end of the wand comprising:

a slide having first and second generally parallel sides mounted on and spaced apart from the wand, a stop extending outwardly from the first and second sides, and an outwardly opening notch on the first and second sides spaced apart from the stops;

a plug electrically coupled to the floor tool; and a connector retaining the plug having two spaced-apart sides, each side having a channel for receiving the slide and a pivotable lock having fingers for retaining the connector on the slide when engaging the notches.

12. In a vacuum cleaner floor tool:

a wand which may be detachably connected to the floor tool;

a slide for receiving an electrical plug mounted on the wand, the slide having a tapered end portion and a pair of opposed notches;

a plug electrically coupled to the floor tool; and a connector attached to the plug for mounting the plug on the wand, the connector having channels for engaging the slide and a pivotally movable lock member for retaining the plug on the wand, the lock member including fingers to be received in the notches of the slide thereby to retain the connector and plug on pivotal movement of the lock into closed position.

13. In a vacuum cleaner floor tool as claimed in claim 12, wherein the fingers of the lock member are flexible such that they are flexed outward as they are forced against the tapered end portion of the slide and then flex back to enter in the notches as the connector is slid into place, whereby the connector may be slidably mounted on the wand with the lock pivoted to closed position.

14. A floor tool for a vacuum cleaner comprising:

a rigid hollow tube detachably connected to the floor tool;

an elongated slide having generally parallel sides on and spaced apart from the surface of the hollow tube, the axis of the slide being generally parallel to the axis of the hollow tube, the slide having outwardly extending stop means and notch means spaced apart from the stop means;

a plug electrically coupled to the floor tool;

a connector for attaching the plug to the hollow tube;

the connector and the plug forming axially extending channels for receiving the slide; and a movable lock on the connector for selectively retaining the connector against the stop means.

* * * * *